US005836020A

United States Patent [19]

Morris

[11] Patent Number: 5,836,020

[45] Date of Patent: Nov. 17, 1998

[54] NON ELECTRICAL INDEPENDENT LIFTS

[75] Inventor: Edward J. Morris, Bay City, Mich.

[73] Assignee: Morris Independent Lift, Bay City, Mich.

[21] Appl. No.: 440,516

[22] Filed: Jun. 16, 1995

[51] Int. Cl.[6] ..... E04H 4/06

[52] U.S. Cl. ..... 4/496; 4/561.1; 4/504; 5/83.1; 414/921

[58] Field of Search ..... 4/496, 667, 504, 4/560.1–566.1; 5/83.1, 85.1, 82.1; 414/921

[56] References Cited

U.S. PATENT DOCUMENTS 3,579,660 5/1971 Whitaker ..... 4/564.1
3,852,835 12/1974 Whitaker ..... 4/562.1
3,925,833 12/1975 Hunter ..... 4/564.1
4,283,803 8/1981 Krumbeck ..... 4/496
4,928,330 5/1990 Moore ..... 4/562.1

*Primary Examiner*—Charles R. Eloshway
*Attorney, Agent, or Firm*—Robert L. McKellar

[57] ABSTRACT

The disclosure herein deals with a series of devices for moving an invalid or handicapped person from a poolside into a pool, and back to the poolside, wherein the invalid or handicapped person may be responsible for the total movement without the aid of a second person. The devices have a novel feature, which is the fact that they can be moved and controlled by the occupant of the lift chair during that movement without the use of direct electrical power.

1 Claim, 16 Drawing Sheets

1
25
27
27'
25'
30
30'
13
13'
11
11'
31
14
15
20
39
20'
29
12
12'
29'
3
21
21'
3'
48
37
5
39
40
48'
43
35
35'
2
34'
34
37
2'
6
38
36
5'
36
42'
42
44
4
8
9
41
7
10
8
4'
5'
44'

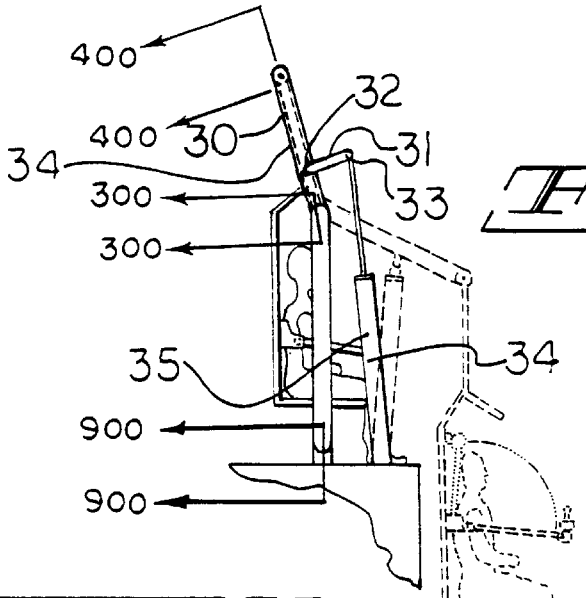
Fig. 3
Fig. 4
Fig. 5
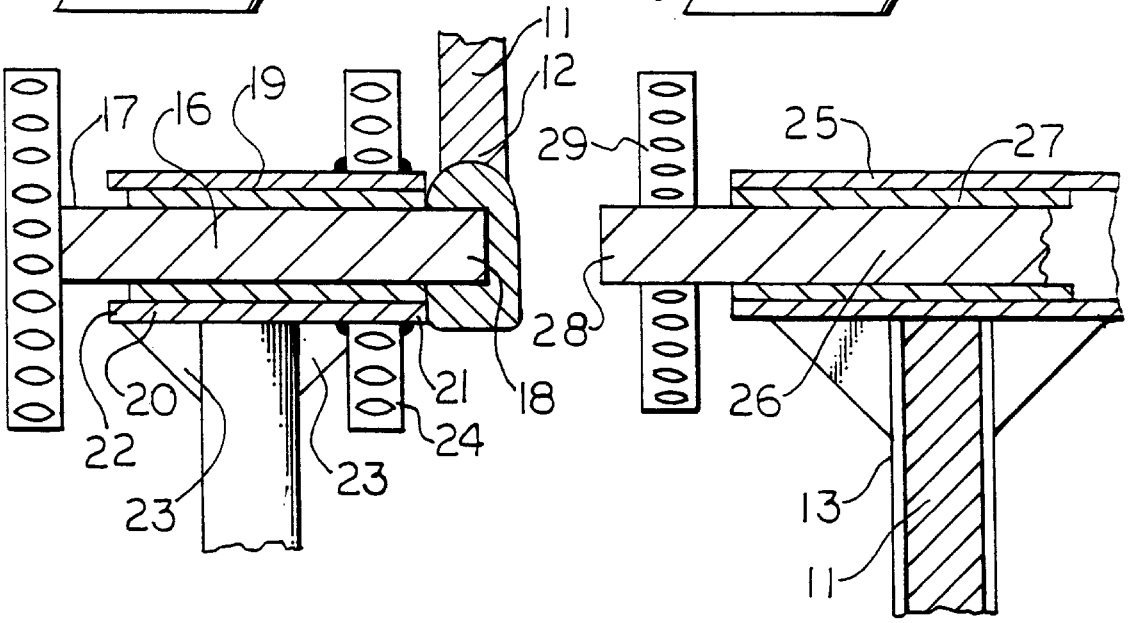

154
158
159
156
157
151
155'
145
130
134
160
147
129
155
159
148
159
149
159
146
160
160
120
157
203
203
158
153
154
143
204
152
142

206
205
146
147
150
159
206
205
207

197
199
198

161
164
165
167
163
165
176
178
173
178
175
192
184
183
182
200
202
162
176
166
178
173
178
175
184
163
208

NON ELECTRICAL INDEPENDENT LIFTS

The invention disclosed and claimed herein deals with a series of devices for moving an invalid or handicapped person from a poolside into a pool, and back to the poolside, wherein the invalid or handicapped person may be responsible for the total movement without the aid of a second person except for one embodiment of the invention. The devices of this invention have a novel feature, which is the fact that they can be moved and controlled during that movement without the use of direct electrical power.

There is further disclosed in this invention, a novel valve for controlling the flow of air, water, or hydraulic fluid, respectively, for the powering of the devices of this invention.

More specifically, this invention deals with a series of non-electrically powered devices which allow independent movement into and out of a pool of water, which devices may or may not be under the control of the invalid or handicapped person, and further, the devices of this invention have an enhanced security for the invalid or handicapped person from falling, or slipping from the support of the device, or being immersed in the pool for a time longer than desired or for a depth that is not desired, or from being moved to dangerous heights above the poolside, in order to accommodate the movements of the devices, and which allow for the mounting of the device away from the edge of the pool, and which provides a barrier to accidental slippage into the pool. The device of this invention has a further security for the invalid or handicapped individual in that the novel chain stabilizer mechanism provided with the devices of this invention allow for the smooth, essentially horizontal movement of the chair from and to the pool.

Thus, in addition to the above, it is a further object of this invention to provide devices which can be operated by the person deriving the benefits of the device, without the intervention or help of a second party.

It is still another object of this invention to provide devices that have no electrical power directly associated with them in order to prevent accidental electrocution in and around a body of water.

It is finally an object of this invention to provide a series of devices that have low maintenance, will not provide potential problems with the environment and which will allow a handicapped or invalid person to utilize them in relative safety because of loading of the support device well away from the water in the pool.

BACKGROUND OF THE INVENTION

A variety of lift devices are known in the prior art for moving invalid or handicapped person from one position to another. In fact, there are several devices disclosed in the prior art which have been found useful specifically for moving persons from the poolside to the pool and back again, or movement to and from a bathtub and the like.

Such devices suffer from flaws in operation, safety, or convenience and the inventor herein, familiar with such devices as a result of having worked in the field for several years, noted these flaws and devised a series of apparati which tend to overcome most, if not all, of such shortcomings.

One such device, and a device believed by the inventor herein as being the closet prior art device, can be found in U.S. Pat. No. 4,996,728, which issued Mar. 5, 1991 to John Nolan. The Nolan device is hydraulically powered and is mounted near the pool edge. However, the Nolan device is comprised of a stabilized single post mounted on a solid substrate, and a hydraulic piston driven assembly which is rigidly mounted to the single post. The lifting chair, attached to the piston shaft has a capability of swinging in a limited arc, to bring the lift chair from the solid substrate to a position over the water, which then allows the piston to drive the lift chair in a downwardly motion. This device requires that the occupant must load and unload very near the edge of the pool, contributing to the advent of accidents.

Most significantly however is the fact that the device of Nolan does not have the movement of the lift chair within the immediate control of the occupant at all times and therefore, the occupant may be unable to stop or reverse it until the end of its travel.

The inventor herein also wishes to note for those skilled in the art that there exists a U.S. Pat. No. 5,383,238, in the name of the inventor herein, which issued on Jan. 24, 1995, in which there is shown a lift device that is electrically powered and which has an electromagnetic brake to control the movement of the lift chair.

THE INVENTION

The invention herein deals with a series of non-electrical powered devices comprising a first device which is an independent lift comprising two spaced apart, vertical posts, wherein each vertical post has a top end and a bottom end, and a front and a back. Each vertical post is capable of being secured by the bottom end to a solid substrate and each vertical post has a plate rigidly affixed near the bottom end. The bottom plate has a top surface and the bottom plate has a connector means detachedly fixed to the top surface.

There are two independent lifting arms and each lifting arm has a near end and a distal end, a midpoint, and a back surface. Each lifting arm is attached to a first rotatable shaft at its near end. Each first rotatable shaft has an outer end and an inner end, and is supported on each of its outer and inner ends by a bearing situated in a first bearing housing, wherein the shaft is supported by the respective bearing within each of the first bearing housings.

Each first bearing housing is fixedly attached to the top respectively, of each vertical post and each first bearing housing has fixedly mounted near its near end, a non-rotating sprocket, which is a rolling chain sprocket.

Each lifting arm is secured near the distal end to a second bearing housing and there is a lifting bar common to both lifting arms which is rotatably secured in each of the second bearing housings and is supported by a bearing within each of the second bearing housings.

The lifting bar extends through the bearing housings to provide a support for a rotating sprocket rigidly affixed to the lifting bar near the end thereof, said sprocket being similar to the non-rotating sprocket, in that it has a rolling chain sprocket configuration.

The non-rotating sprocket and the rotating sprocket are connected by a non-rotating chain.

Each lifting arm has a rigid brace with a near end and a distal end fixedly attached at the near end to the back surface of the lifting arm at or near the midpoint of the lifting arm.

There are two, essentially identical hydraulic assemblies, having a fixed end and a shaft end, and the hydraulic assemblies have a housing, a movable piston therein and a piston shaft attached to the piston. Each such hydraulic assembly is mounted on the top surface of the bottom plate by the respective connector means and each piston shaft is pivotally attached to the distal end of the rigid brace on each of the respective lifting arms.

The lifting bar has a lifting chair rigidly attached to it by chair support shafts and the chair is provided with a control for the control of the pistons in the hydraulic assemblies.

Each vertical post has a lower bearing housing fixedly attached near the lower end of the vertical post and containing therein a bearing. The independent lift has a lower rotating bar common to the vertical posts and the lower rotating bar extends from one vertical post to the other vertical post and through the lower bearing housing and is supported by the bearings located therein.

There is a set of lower sprockets detachedly fixed to each end of the lower rotating bar and such that these sprockets are capable of being rotated simultaneously with the rotation of the lower rotating bar. Each of the lower sprockets is connected to a middle sprocket by a rotatable chain.

One of the vertical posts has attached on its back, a manifold to accommodate the power means for the lift which means powers the piston in each piston assembly.

It is contemplated within the scope of this invention that the chains and the respective drive mechanisms can be covered with covers to prevent accidents.

With regard to a second device of this invention there is provided an independent lift comprising a single vertical post, wherein the post has a top end and a bottom end and each vertical post is capable of being secured by the bottom end to a solid substrate.

There is an independent lifting arm, and the lifting arm has a near end and a distal end and the lifting arm is attached to a first rotatable shaft at its near end. The first rotatable shaft has an outer end and an inner end and is supported on each of its outer and inner ends by bearings situated in a first bearing housing, the shaft being supported by a bearing within the first bearing housing.

The first bearing housing is fixedly attached to the top of the vertical post and has mounted near its near end, a non-rotating sprocket which is a rolling chair sprocket.

The lifting arm is secured near the distal end to a second bearing housing and a lifting bar is rotatably secured in the second bearing housing and is supported by a bearing within the second bearing housing.

The lifting bar extends through the bearing housing to provide support for a rotating sprocket rigidly affixed to the lifting bar and the rotating sprocket is similar to the non-rotating sprocket in that it is essentially the same size and is a rolling chain sprocket.

The non-rotating sprocket and the rotating sprocket are connected by a non-rotating chain.

There is a first gear fixedly attached to the first rotatable shaft at the outer end, and a second gear aligned and meshing with the first gear, said second gear mounted on a shaft which is rigidly mounted on the vertical post. There is a drive shaft attached to the second gear and capable of turning simultaneously with the second gear. Although it is not shown, there can be used a housing to enclose the first and second gears in order to provide safe operation.

The lifting bar has a lifting chair rigidly attached to it by a chair support shaft.

There is yet a third device within this series, said device being an independent lift comprising a single vertical post wherein the post has a front, a back, a top end and bottom end and the vertical post is capable of being secured by the bottom end to a solid substrate.

The vertical post has a plate rigidly affixed to the bottom end and the plate has a top surface which has a connector means detachedly fixed to said top surface.

There is an independent lifting arm and the lifting arm has a midpoint, a near end, a distal end, and a back surface and the lifting arm is attached to a first rotatable shaft at the near end, wherein the first rotatable shaft has an outer end and an inner end and is supported on each of the outer and inner ends by a bearing situated in a first bearing housing whereby the shaft is supported by the respective bearing within the first bearing housing.

The first bearing housing is fixedly attached to the top of the vertical post and the first bearing housing has mounted near the near end, a non-rotating sprocket which is a rolling chain type of gear.

The lifting arm is secured near the distal end to a second bearing housing and there is a lifting bar rotatably secured in the second bearing housing and being supported by a bearing within the second bearing housing.

The lifting bar extends through the bearing housing to provide support for a rotating sprocket rigidly affixed to the lifting bar, this rotating sprocket being similar to the non-rotating sprocket in size and configuration, which is a rolling chain sprocket. The non-rotating sprocket and said rotating sprocket are connected by a non-rotating chain.

The lifting arm has a rigid brace with a near end and a distal end and the rigid brace is fixedly attached at the near end to the back surface of the lifting arm, and at or near the midpoint of the lifting arm.

There is a hydraulic assembly having a fixed end and a shaft end wherein the hydraulic assembly has a housing, a movable piston therein and a piston shaft attached to the piston, the hydraulic assembly being mounted on the top of the solid substrate and fastened thereto by the connector. The piston shaft is pivotally attached to the distal end of the rigid brace on the lifting arm.

The lifting bar has a lifting chair rigidly attached to it by a chair support shaft and the chair is provided with a control for the control of the piston in the hydraulic assembly.

The independent lift is provided with a means to power the piston. The vertical post has attached on the back surface, a manifold to accommodate the power means.

Finally, there is a fourth device of this inventive series which is an independent lift comprising a single vertical post wherein the post has a front, a back, a top end and a bottom end and the vertical post is capable of being secured by the bottom end to a solid substrate.

There is an independent lifting arm and the lifting arm has a near end and a distal end and the lifting arm is attached to a first rotatable shaft at the near end wherein the first rotatable shaft has an outer end and an inner end and is supported on each of the inner and outer ends by a bearing situated in a first bearing housing, wherein the shaft is supported by the respective bearing within the first bearing housing.

The first bearing housing is fixedly attached within a rack and pinion housing fixedly surmounting the vertical post and it has mounted near the near end, a non-rotating sprocket, which sprocket is of the rolling chain sprocket.

The lifting arm is secured near the distal end to a second bearing housing and the lifting bar is rotatably secured in the second bearing housing and the lifting bar is supported by the bearing therein.

The lifting bar extends through the bearing housing to provide support for a rotating sprocket rigidly affixed to the lifting bar, said rotating sprocket being similar to the non-rotating sprocket in that its is essentially the same size and type of sprocket which has a rolling chain sprocket configuration. The non-rotating sprocket and said rotating sprocket are connected by a non-rotating chain.

The lifting bar has a lifting chair rigidly attached thereto by a chair support shaft, the chair being provided with a control.

The first rotating shaft has mounted on the distal end a spur pinion gear in parallel axis alignment with a rack, one end of said rack having threadedly adapted thereto in linear alignment with said rack, a threaded, elongated bar having a distal end, said distal end of the elongated bar linearly extending through and outside the rack and pinion housing.

There is a piston and the piston has a center aperture and an outside perimeter wherein the piston is detachedly mounted on the elongated bar through said aperture and the piston is housed in a piston housing having an inside surface. The piston has one or more seals around its outside perimeter to seal the piston against the inside surface of the piston housing. The piston housing has two separable ends, each separable end having an outside perimeter and at least two rod openings near said outside perimeter, each said end being coupled to the piston housing by two or more elongated rods, each said elongated rod having threaded ends, said coupling being provided by threaded fasteners on each of the threaded ends, each said threaded fastener being compressed tightly against said separable ends to enclose the piston.

There is a means of powering the piston and a means of controlling the movement of the piston.

Yet another aspect of this invention is a new and novel valve device that is used to control the devices of this invention that are powered with hydraulic fluid, water, air, or other gasses.

BRIEF DESCRIPTION OF THE DRAWINGS

FIG. 3 is a full side view of the device of FIGS. 1 and 2, where there is shown in phantom the forward movement of the chair with occupant.

FIG. 4 is an enlarged sectional side view of the first bearing housing and mechanism associated therewith through line 300—300 of FIG. 3.

FIG. 5 is an enlarged sectional side view of the second bearing housing and mechanism associated therewith through line 400—400 of FIG. 3.

FIG. 17 is an enlarged side view of the piston and rack and pinion of FIG. 14 shown the relationship of the piston, rack and pinion and the first rotatable shaft.

DETAILED DESCRIPTION OF THE INVENTION

Figure 1:
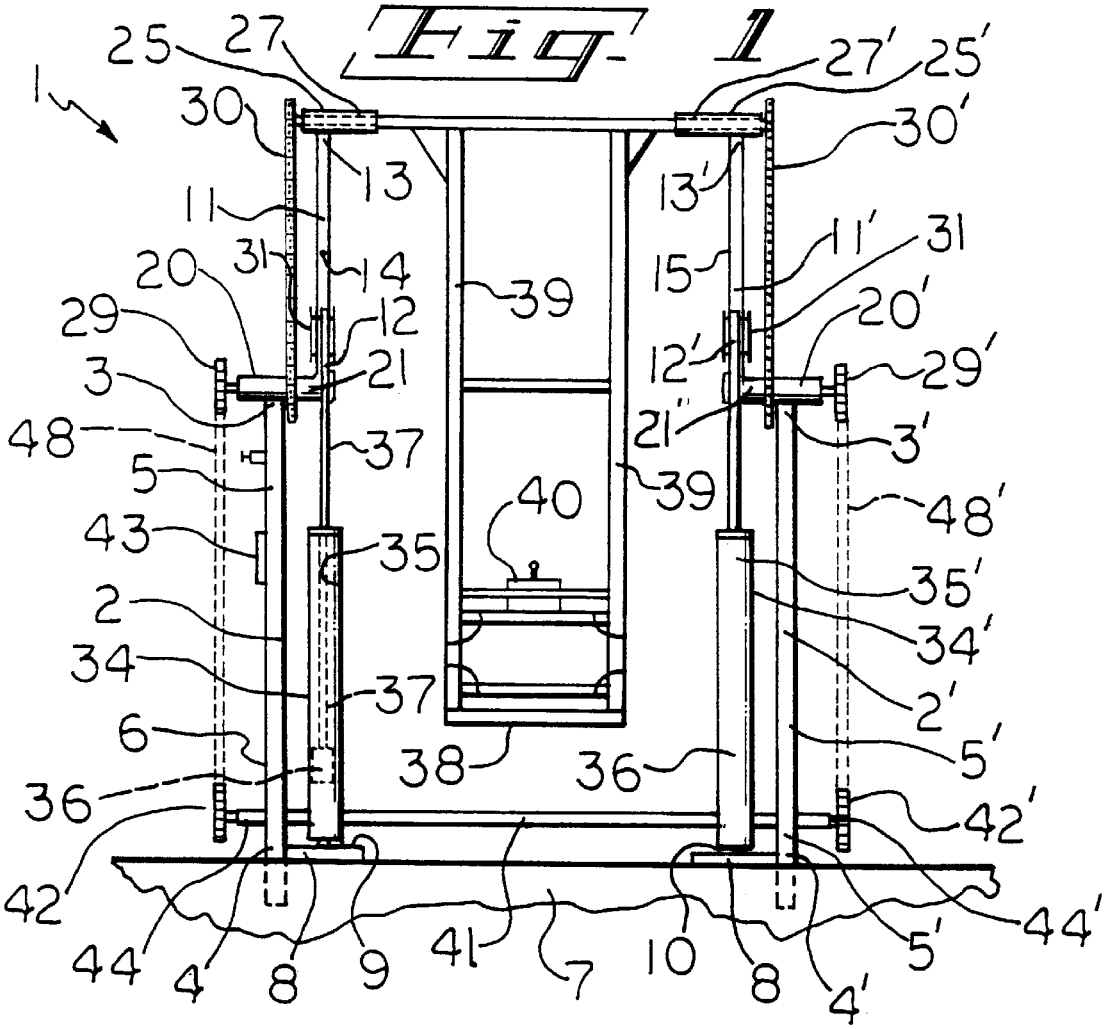
FIG. 1 is a full front view of the first device of this invention, showing a lift chair with control, support, and drive mechanism, wherein the middle sprockets and lower sprockets are shown as being moved away from the vertical post and without pressure hoses, all for purposes of clarity.

Now, with reference to FIG. 1, there is shown a first device of this invention, which is a mechanical independent lift 1, having two spaced apart, vertical posts 2 and 2', wherein each vertical post 2 and 2' has a top end 3, a bottom end 4, a front 5, and a back 6. Each of the vertical posts 2 and 2' is capable of being secured by the bottom end 4, to a solid substrate 7. Each of the vertical posts 2 and 2' has a plate 8 rigidly affixed to the bottom end 4 and the plate 8 has a top surface 9 which is surmounted with a fixedly attached connector means 10.

The independent lift 1 has two independent lifting arms 11 and 11'. Each of the lifting arms 11 and 11' have a near end 12 and 12' and a distal end 13 and 13', a midpoint 14, and a back surface 15. With reference to FIG. 4, each of the lifting arms 11 and 11' is attached to a first rotatable shaft 16 at its near end 12 (lifting arm 11 shown only). The first rotatable shaft 16 has an outer end 17 and an inner end 18. The rotatable shaft 16 is supported on its outer end 17 and its inner end 18 by a bearing 19 which is situated in first bearing housing 20. The shaft 16 is supported by the bearing 19 within the first bearing housings 20 and 20'.

Each first bearing housing 20 and 20' has a near end 21 and 21' and a distal end 22 and 22', and is fixedly attached to the top respectively, of each vertical post 2 and 2'. In some instances, this connection may have to have support brackets 23 to help stabilize the housings 20 and 20'.

Each of the bearing housings 20 and 20' has fixedly mounted near their near ends 21 and 21' a non-rotating sprocket 24. This sprocket 24 is a roller chain type of sprocket.

With regard to FIG. 5, each of the lifting arms 11 and 11' are secured respectively near their distal end 13 to a second bearing housing 25 and 25'.

There is a lifting bar 26, common to both lifting arms 11 and 11'. The lifting bar 26 is rotatably secured in each of the second bearing housings 25 and 25' and the lifting bar 26 is supported by the bearings 27 and 27' within the second bearing housings 25 and 25'.

The lifting bar 26 extends through the second bearing housing 25 and 25' to provide a support 28 for an upper rotating sprocket 29, which is rigidly affixed to the lifting bar 26 at the support 28. The non-rotating sprocket 24 and the upper rotating sprocket 29 are connected by a non-rotating chain 30.

With reference to FIG. 3, each of the lifting arms 11 and 11' has a rigid brace 31 with a near end 32 and a distal end 33, fixedly attached at the near end 32, to the back surface 15 of the of the lifting arms 11 and 11', at or near its midpoint 14.

There are two essentially identical hydraulic assemblies 34 and 34' having a housing 35, a moveable piston 36 (shown in phantom in the left hydraulic assembly), and a piston shaft 37 (in phantom inside the hydraulic housing) attached to the piston 36. Each hydraulic assembly 34 and 34' are mounted on the top surface 9 of the bottom plate 8 by the connector means 10. Each piston shaft 37 is pivotally attached to the distal end 33 of the rigid brace 31 on each of the respective lifting arms 11 and 11'.

The lifting bar 26 has a lifting chair 38 rigidly attached to it by chair support shafts 39. The lifting chair 38 is provided with a control 40 for the control of the pistons 36 in the hydraulic assemblies 34 and 34'.

Figure 6:
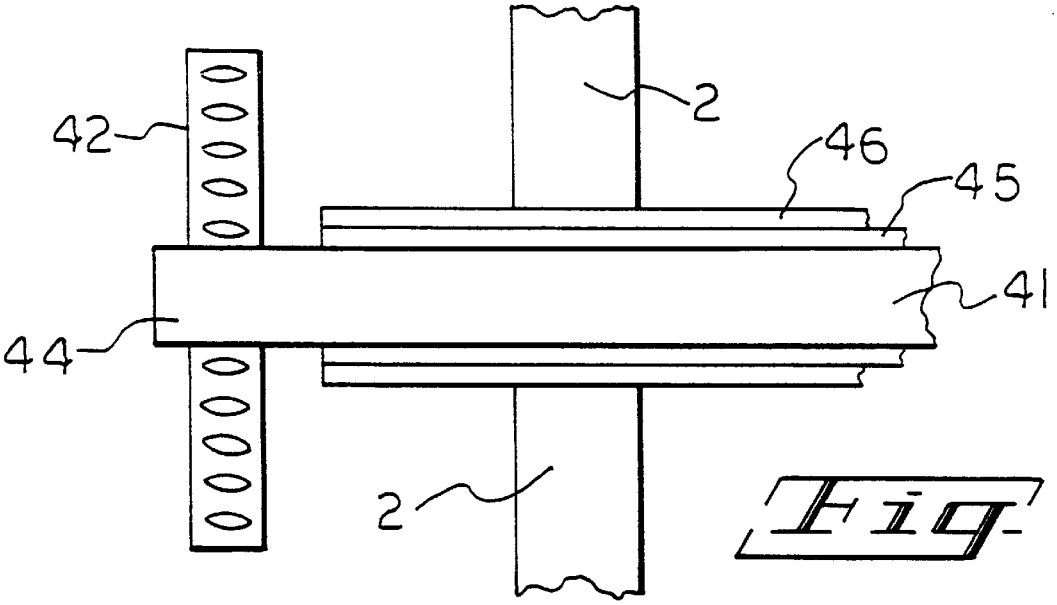
FIG. 6 is an enlarged cross sectional view of the lower bearing housing of FIG. 3, through the lines 900—900.

The independent lift 1 has a rotating bar 41 common to the vertical posts 2 and 2', which extends through the vertical posts 2 and 2' to provide a support means 42 for two lower rotating sprockets 42 and 42'. The rotating bar 41 is attached to the vertical posts 2 and 2' near the bottom end 4 of each respective vertical post 2 and 2'. The rotating bar 41 is supported at each of its ends 44 and 44' by bearings 45 and 45', which are located in third bearing housings 46 and 46', which are shown in enlarged detail in FIG. 6. There is a rotating chain 48 connecting the lower rotating sprocket 42 and the middle rotating sprocket 29, and a rotating chain 48' connecting the lower rotating sprockets 42' and the middle rotating sprocket 29' such that when one set of sprockets moves, the second set of sprockets moves simultaneously. This configuration allows for the simultaneous movement of the lifting arms 11 and 11' so that there is no twist or torque associated with the lifting bar 26. Also, this configuration lends a braking effect to the device such that the lifting chair 38 always moves in a smooth arc, with the lifting chair 38 always at the lowest possible level during the swing of the lifting chair 38 through the moving arc.

One of the vertical posts 2, for example, has attached on its back 6, a manifold assembly 43 for the independent lift 1. The independent lift 1 is adapted by means to power the pistons 36 in the piston assemblies 34 and 34'.

As discussed above, the sprocket 24 and upper sprocket 29 are connected together by chain 30. When the hydraulic assemblies 34 and 34' are activated by the control 40, the pistons 36 move within the housings (cylinders), which in turn moves the shafts 37, which in turn moves the lifting arms 11 and 11'. Because the shafts 37 are pivotally attached to the rigid braces 31, the lifting arms 11 and 11' move simultaneously with the movement of the piston shafts 37 to raise or lower the lifting arms 11 and 11'. When the lifting arms 11 and 11' are moved, the lifting bar 26 rotates because the weight in the lift chair allows the chair 38 to seek the lowest possible position because of the force of gravity. However, the sprocket 29 is rigidly attached to the lifting bar 26 and that sprocket turns when the lifting bar 26 turns. This could potentially create a swinging motion to the chair. Because the lower sprocket 24 is fixed, that is, it does not rotate, the chain 30 is held essentially motionless and the chair 38 is smoothly carried through the descending or ascending arc without swinging or moving rapidly through the arc. The movement of the lifting arms 11 and 11' turn the first rotating shafts 16 which in turn rotate the middle sprockets 29 and 29', which rotates the chains 48 and 48', which move simultaneously and rotate the lower rotating sprockets 42 and 42' which commonly drive the rotating bar 41. By this means, the movement of the chair 38 is smooth and because the lifting arms 11 and 11' operate simultaneously with the rotating lifting bar, the height of movement of the chair 38 from the ground level is not very high. On the other hand, the length of the lifting arms 11 and 11' allows one to move the chair lift 38 a goodly distance from the edge of the pool, mount the chair 38 in relative safety, and still have the flexibility to lower the chair lift 38 to a considerable depth in the pool as can be observed from FIG. 2.

FIG. 3 is a full side view of the first device of this invention showning in phantom, the forward movement of the chair and occupant into a pool. There is also shown in phantom therein the forward movement of the piston assembly and the lifting arm to accommodate the forward movement of the chair and occupant.

The devices of this invention are powered by hydraulics, water pressure or air/gas pressure. With regard to FIG. 2, there is shown one embodiment of the pressure hoses 49 of this invention in a typical hook up to the device 1.

Figure 2:
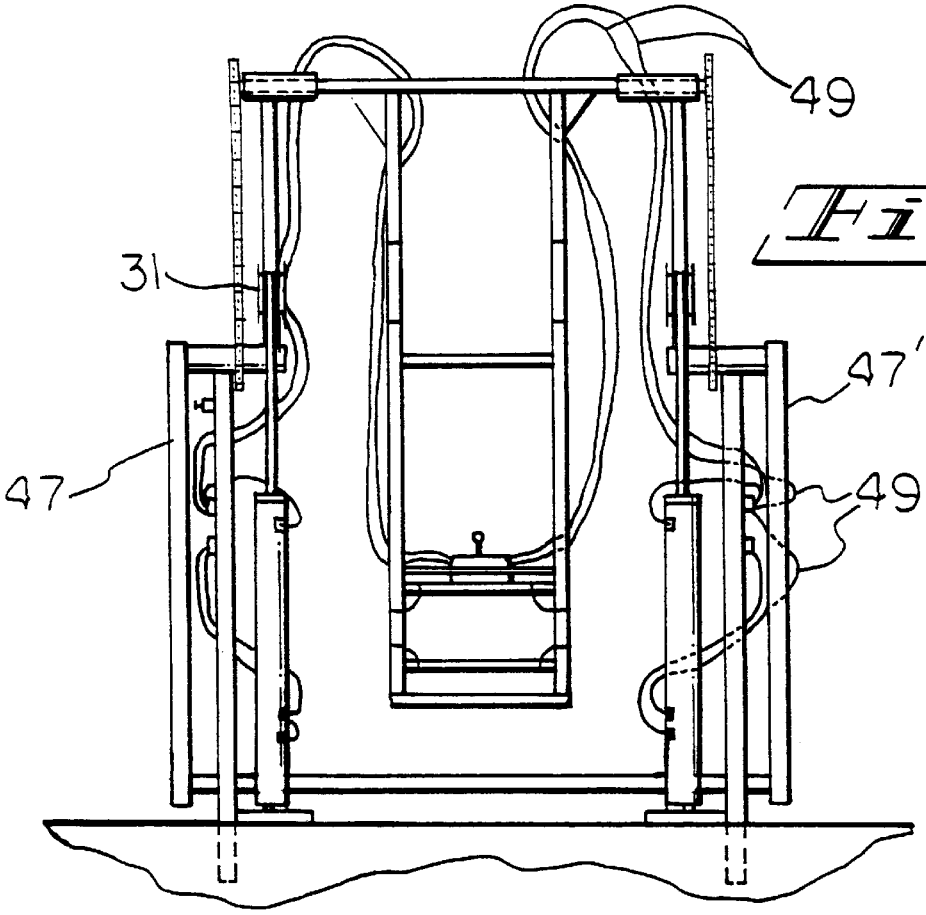
FIG. 2 is a full front view of the first device of this invention showing pressure hoses useful on the device and the protective covers in place.

As can be observed from FIG. 2, the inventor herein, for each of the devices described and claimed herein, contemplates the use of safety shields 47 and 47' over the moving chains 48 and 48', and the rotating sprockets 42, 42', 29 and 29'. FIG. 2 shows the extensive placement of the pressure hoses, the controls, and the manifolds that are required to power the devices of this invention, and such items have been essentially left off of the remainder of the Figures for the sake of clarity, it being understood that except for the second device of this invention, each such device will need the hoses, controls and manifolds similar to those shown in FIG. 2.

The chair lift 38 can be operated by the person in the chair 38 and this person has complete control over the movement of the chair 38. Finally, there are no electrical problems to worry about like when one uses an electrically powered unit. It should be noted by those skilled in the art that the chain and sprockets of this device can operate as a brake for the chair, as well as a means of moderating the rate of movement of the chair.

Figure 7:
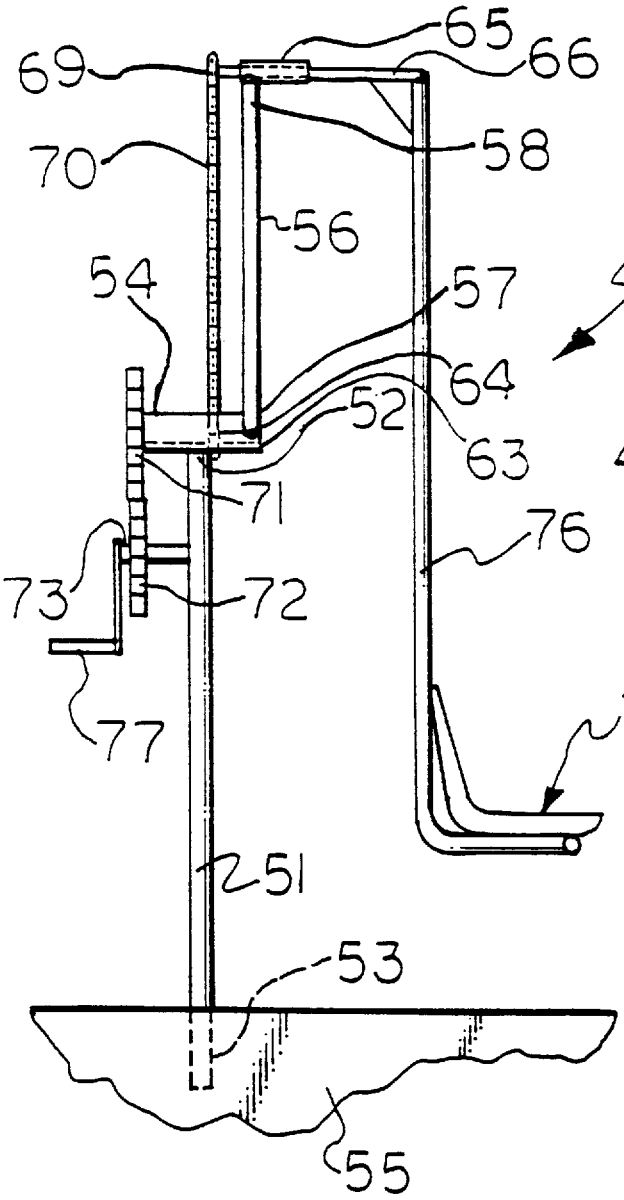
FIG. 7 is a full side view of a second device of this invention in which the device is powered by a hand crank.
Figure 8:
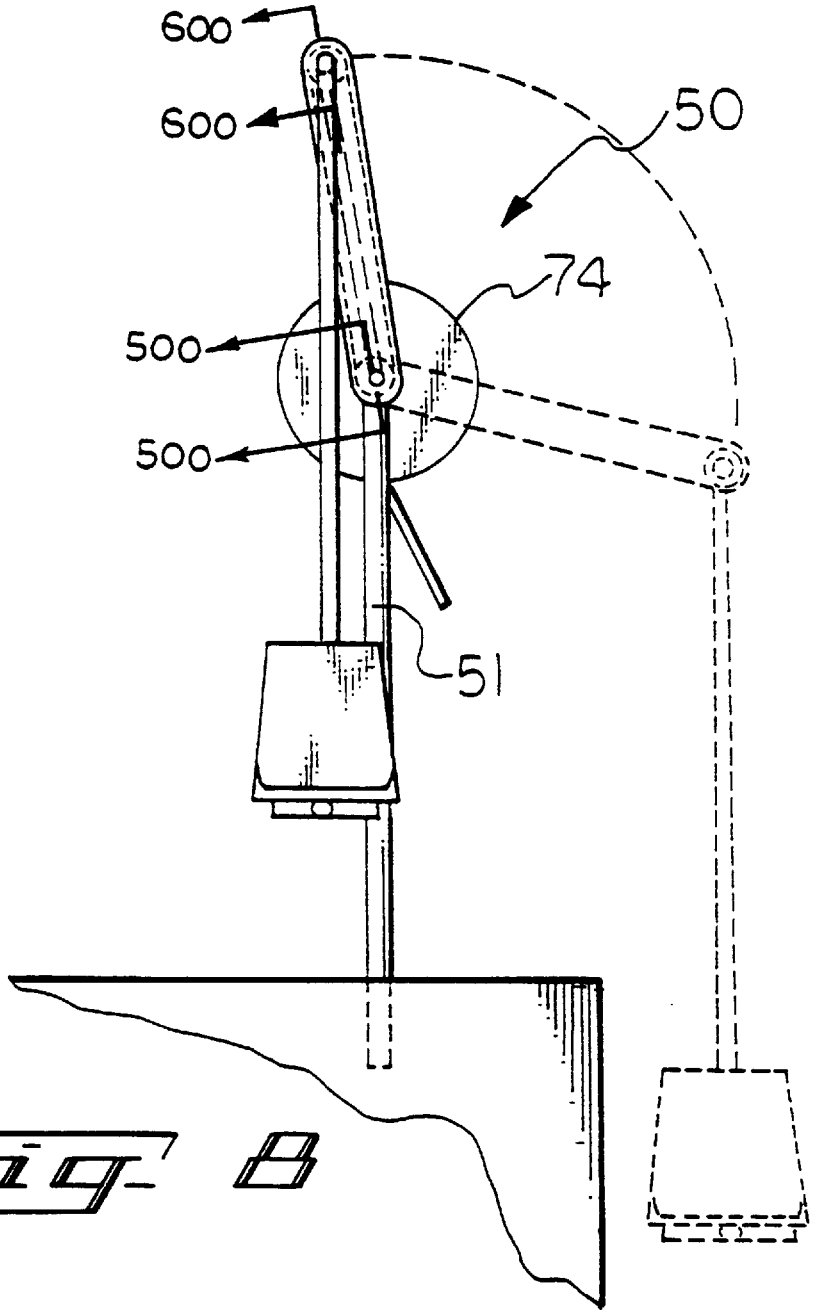
FIG. 8 is a full front view of the device of FIG. 7 where there is shown in phantom the sideward motion of the chair into a pool.

Turning now to FIGS. 7 and 8 and the second device of this invention, there is shown an independent lift 50. In contrast to the first device of this invention, this independent lift has a single vertical post 51, said post 51 having a top end 52 and a bottom end 53. The vertical post 51 is capable of being secured by the bottom end 53 to a solid substrate 55.

Figure 9:
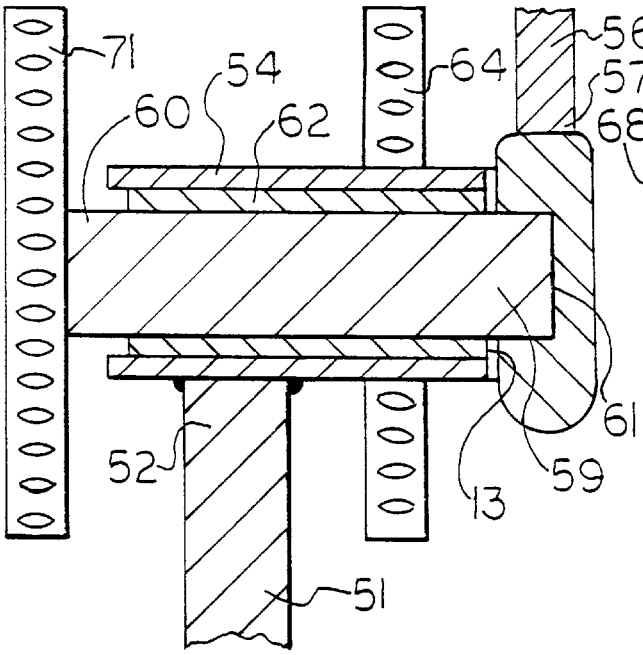
FIG. 9 is an enlarged sectional side view of the first bearing housing of the second device of this invention and the mechanism associated therewith, through line 500—500 of FIG. 8.
Figure 10:
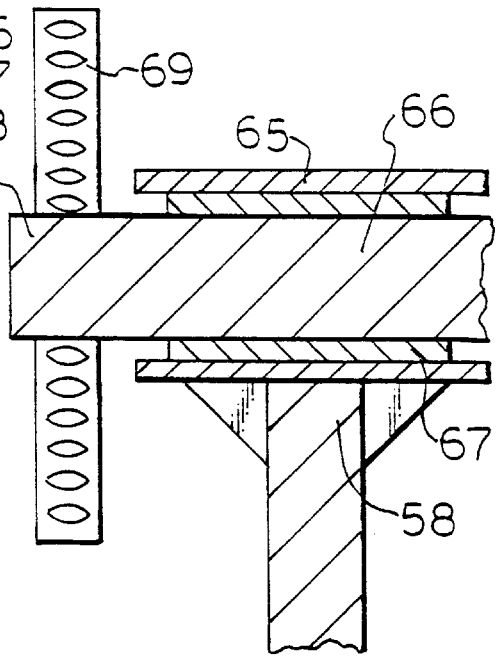
FIG. 10 is an enlarged sectional side view of the second bearing housing of the second device of this invention and the mechanism associated therewith, through line 600—600 of FIG. 8.

With respect to FIGS. 7 and 8, and in more detail in FIGS. 9 and 10, there is shown an independent lifting arm 56, said lifting arm 56 having a near end 57 and a distal end 58. The lifting arm 56 is attached to a first rotatable shaft 59 at the near end 57. The first rotatable shaft 59 has an outer end 60 and an inner end 61, the first rotatable shaft 59 being supported on each of its outer end 60 and inner end 61 by a bearing 62 situated in a first bearing housing 54, the first rotatable shaft 59 being supported by the bearing 62 within the first bearing housing 54. The first bearing housing 54 is fixedly attached to the top 52 of the vertical post 51. The first bearing housing 54 has mounted near its near end 63, a non-rotating sprocket 64. The lifting arm 56 is secured near its distal end 58 to a second bearing housing 65.

There is a lifting bar 66 rotatably secured in the second bearing housing 65, said lifting bar 66 being supported by a bearing 67 within the second bearing housing 65. The lifting bar 66 extends through the second bearing housing 65 to provide support 68 for a rotating sprocket 69 rigidly affixed to the lifting bar 66 by the support 68. The non-rotating sprocket 64 and the rotating sprocket 69 are connected by a non-moving chain 70.

There is a first gear 71 fixedly attached to the first rotatable shaft 59 at its outer end 60. A second gear 72 is aligned and meshes with the first gear 71, the second gear 72 being mounted on the vertical post 51.

There is also provided a drive shaft 73 attached to the second gear 72 which is capable of turning simultaneously with the second gear 72. A housing 74 shown in FIG. 8, but not shown in FIG. 7 for clarity, encloses the first gear 71 and the second gear 72.

The lifting bar 66 has a lifting chair 75 rigidly attached to it by a chair support shaft 76. The drive shaft 73 has attached to it some means of powering it and as shown in FIG. 7, there is a crank handle 77. However it is contemplated within the scope of this invention to equip the drive shaft 73 with other means of power, such as for example, adapting a water pump to the drive shaft 73.

The second device is a much simplified version of the first device and it can be observed that the same principle applies with regard to the non-rotating sprocket 64, the rotating sprocket 69 and the stationary chain 70. This device is intended to be economical in that it can be powered by a hand crank associated with a set of gears. This device allows for the safe mounting of the lift chair from a goodly distance away from the pool, yet allows for the person in the chair to be lowered a considerable distance into the pool. This device differs from the first device in that it requires that a person other than the person using the lift chair to operate the power means.

Figure 11:
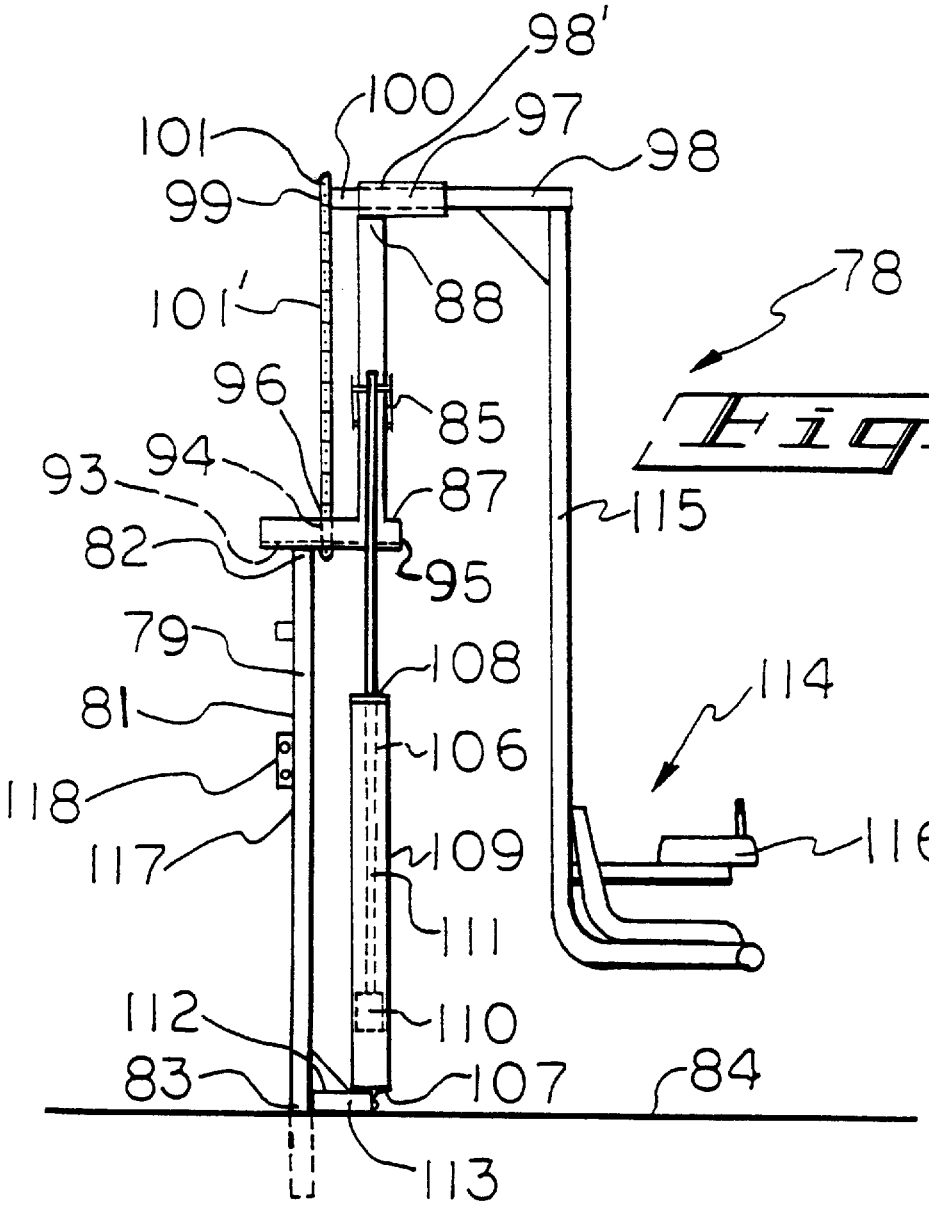
FIG. 11 is a full side view of a third device of this invention in which the device is powered by a single piston assembly.
Figures 12, 14:
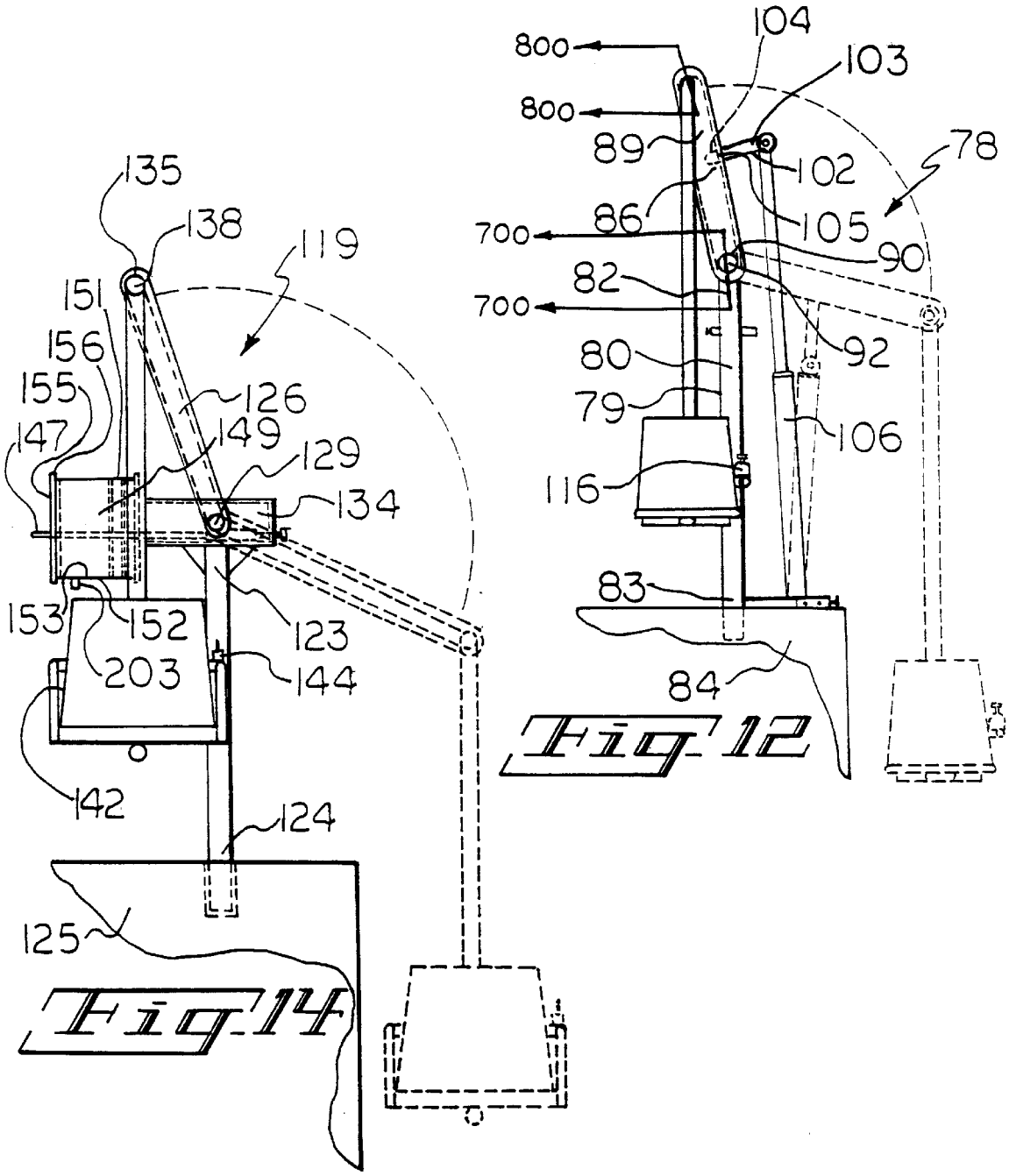
FIG. 12 is a full front view of the device of FIG. 11 wherein there is also shown the sideward movement of the chair in phantom.
FIG. 14 is a full front view of the device of FIG. 13 also showing in phantom the sideward movement of the chair in phantom.

With regard to the third device of this invention, reference is made to FIGS. 11 and 12 wherein there is shown a device 78 which is a single post, piston driven device.

There is shown therein a single vertical post 79 and the post has a front 80, a back 81, a top end 82, and a bottom end 83. The vertical post 79 is capable of being secured by the bottom end 83 to a solid substrate 84.

There is shown an independent lifting arm 85 and the lifting arm 85 has a midpoint 86, a near end 87, a distal end 88, and a back surface 89. The lifting arm 85 is attached to a first rotatable shaft 90 at the near end 87 and the first rotatable shaft 90 has an outer end 91 and an inner end 92. The first rotatable shaft 90 is supported on each of its outer ends 91 and 92 by a bearing 93 which is situated in a first bearing housing 94. The first rotatable shaft 90 is supported by the bearing 93 within the first bearing housing 94.

The first bearing housing 94 is fixedly attached to the top end 82 of the vertical post 79 by welding or some other convenient means. The first bearing housing 94 has mounted near its near end 95, a non-rotating sprocket 96. The lifting arm 85 is secured near the distal end 88 to a second bearing housing 97.

There is a lifting bar 98 rotatably secured in the second bearing housing 97 and is supported by a bearing 98 within the second bearing housing 97.

The lifting bar 98 extends through the second bearing housing 98 to provide support 100 for a rotating sprocket 99 which is rigidly affixed to the lifting bar 98 by the support 100.

The non-rotating sprocket 101 and said rotating sprocket 99 are connected together by a non-rotating chain 101.

The lifting arm 85 has a rigid brace 102 with a near end 103 and a distal end 104 and the rigid brace 102 is fixedly attached at the near end 104 to the back surface 89 of the lifting arm 85 and at or near the midpoint 105 of the lifting arm 85.

There is a hydraulic assembly 106 having a fixed end 107 and a shaft end 108, said hydraulic assembly 106 has a housing 109, a movable piston 110 therein and a piston shaft 111 attached to the piston 110, said hydraulic assembly 106 is mounted on the top 112 of a plate 113, which is mounted on the top of the solid substrate 84, the piston shaft 111 is pivotally attached to the distal end 104 of the rigid brace 102 on the lifting arm 85.

The lifting bar 98 has a lifting chair 114 rigidly attached to it by a chair support shaft 115, said chair 114 being provided with a control 116 for the control of the piston 110 in the hydraulic assembly 106. The vertical post 79 has attached on the back surface 117, a manifold 118 for the independent lift 78. The independent lift 78 is adapted by means to power the piston 110 in each piston assembly 106, which power means is not shown in the Figures.

The detail of the rotating shafts, sprockets, and the like is analogous to that found in FIGS. 9 and 10.

Figure 13:
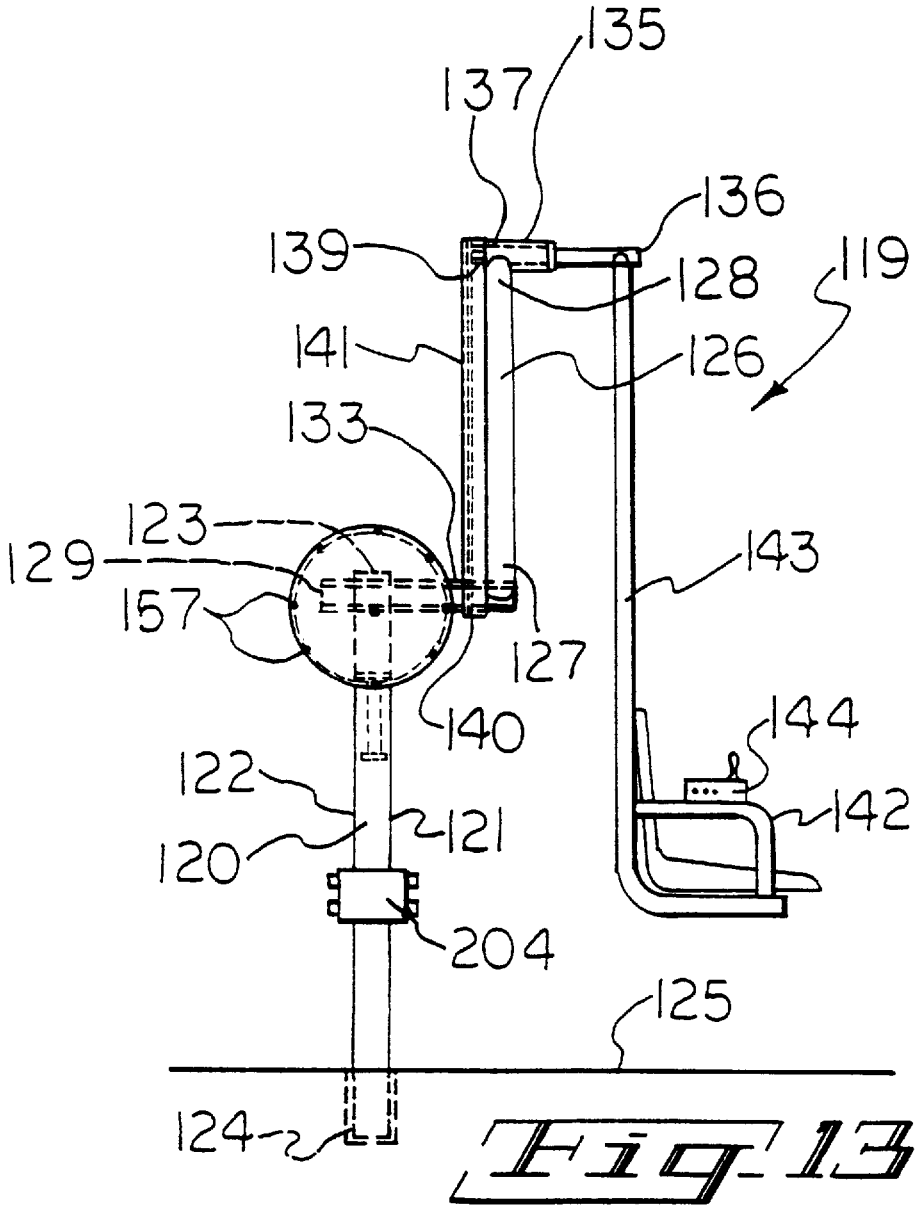
FIG. 13 is a full side view of the fourth device of this invention.
Figure 15:
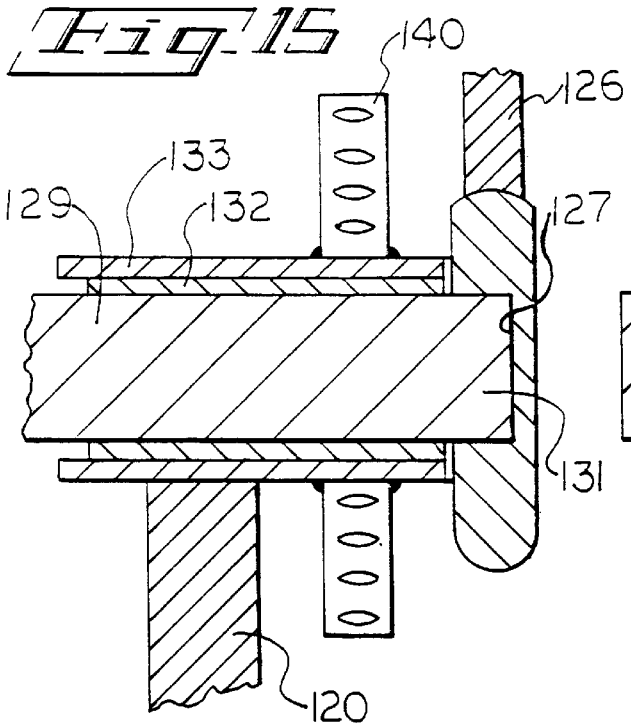
FIG. 15 is a sectional side view of the first bearing housing and associated mechanism taken through the line 700—700 of FIG. 12.
Figure 16:
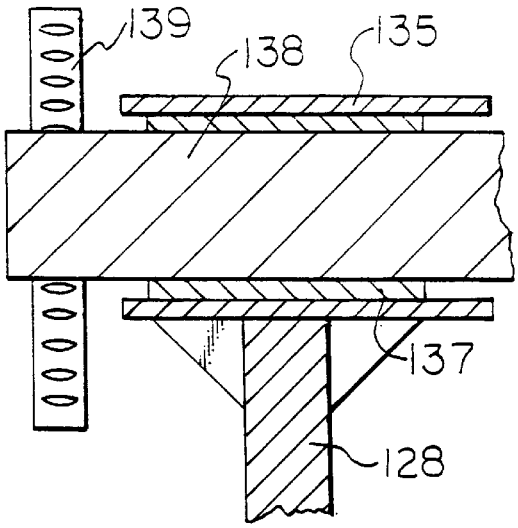
FIG. 16 is a sectional side view of the second bearing housing and associated mechanism taken through the line 800—800 of FIG. 12.
Figure 11:
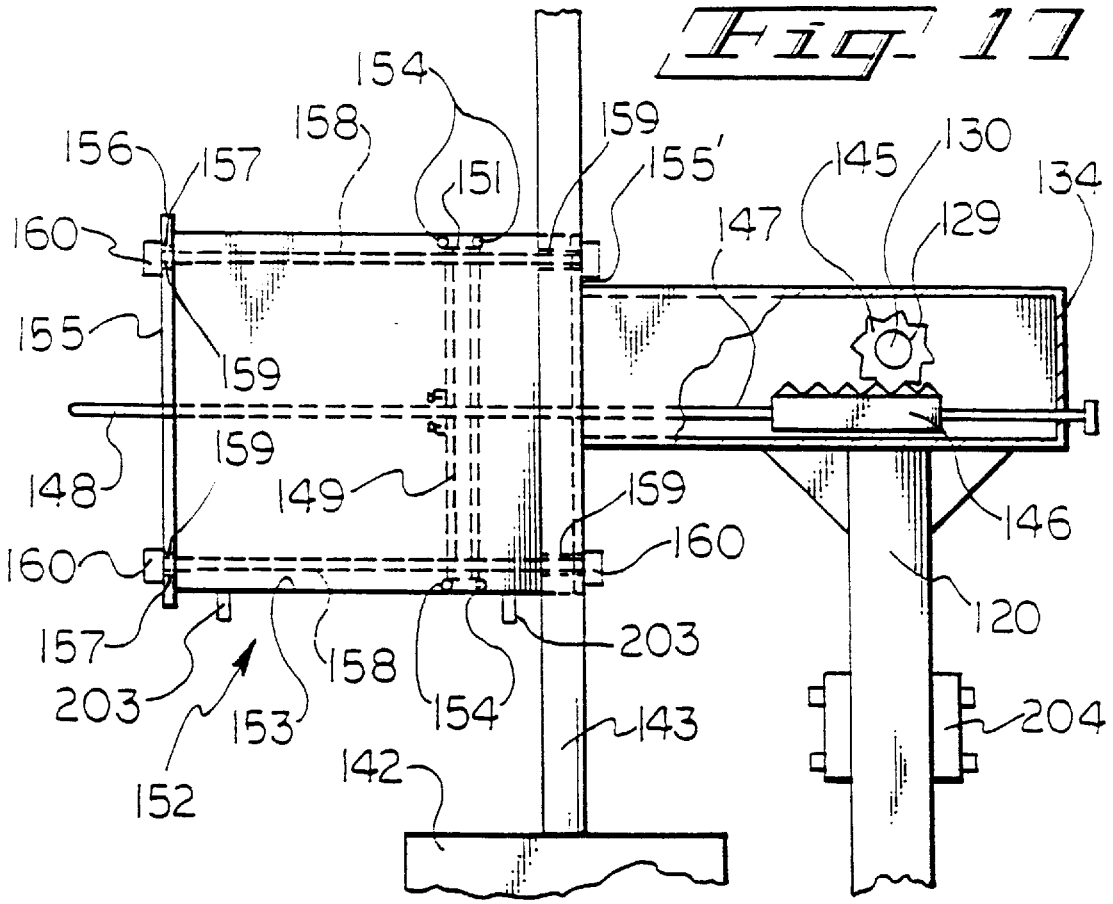

With regard to the fourth device of this invention and with reference to FIGS. 13 and 14, there is shown a device 119 which comprises a vertical post 120 wherein the vertical post 120 has a front 121, a back 122, a top end 123, and a bottom end 124. The vertical post 120 is capable of being secured by the bottom end 124 to a solid substrate 125. With reference to FIGS. 13, 14, and 15, there is an independent lifting arm 126 and the lifting arm 126 has a near end 127 and a distal end 128. The lifting arm 126 is attached to a first rotatable shaft 129 at its near end 127 and the first rotatable shaft 129 has an outer end 130 and an inner end 131. The first rotatable shaft 129 is supported on each of the inner end 131 and the outer end 130 by a bearing 132, the bearing 132 being situated in a first bearing housing 133, the first rotatable shaft 129 being supported by the bearing 132 within the first bearing housing 133. The first bearing housing 133 is fixedly attached within a rack and pinion housing 134 which fixedly surmounts the vertical post 120.

The lifting arm 126 is secured near the distal end 128 to a second bearing housing 135. A lifting bar 136 is rotatably secured in the second bearing housing 135 which has a bearing 137 located therein and the lifting bar 136 is supported by the bearing 137 therein.

The lifting bar 136 is rotatably secured in the second bearing housing 135 and the lifting bar 136 is supported by the bearing 137 located in the second bearing housing 135. The lifting bar 136 extends through the second bearing housing 135 to provide a support 138 for a rotating sprocket 139 rigidly affixed to the lifting bar 136 by the support 138. The non-rotating sprocket 140 and the rotating sprocket 139 are connected together by a non-rotating chain 141.

The lifting bar 136 has a lifting chair 142 rigidly attached thereto by a chair support shaft 143, the chair 142 being provided with a control 144.

The first rotating shaft 129 has mounted on the outer end 130, a spur pinion gear 145 in parallel axis alignment with a rack 146, one end of the rack 146 has threadedly adapted thereto in linear alignment with said rack 146, a threaded, elongated bar 147 having a distal end 148, and the distal end 148 of the elongated bar 147 linearly extends outside the rack and pinion housing 134.

There is a piston 149 having a center aperture 150 and an outside perimeter 151, and the piston 149 is detachedly mounted on the elongated bar 147 through the aperture 150. The piston 149 is housed in a piston housing 152 having an inside surface 153 and the piston 149 has one or more seals 154 around the outside perimeter 151 to seal the piston 149 against the inside surface 153 of the piston housing 152.

The piston housing 152 has two separable ends 155 (right end 155' is shown in phantom in FIG. 17), each separable end 155 and 155' has an outside perimeter 156 and at least two rod openings 157 near the outside perimeter 156. Each of the ends 155 being coupled to the piston housing 152 by two or more elongated rods 158 (shown in phantom in FIG. 17), each said elongated rod 158 having threaded ends 159.

The coupling is provided by threaded fasteners 160 on each of the threaded ends 159, each said threaded fastener 160 being compressed tightly against the separable ends 155.

There is a means of powering the piston 149 which is not shown, but the connections 203 are shown in FIG. 17, and a means 204 of controlling the movement of the piston 149 is shown in FIG. 17 at the vertical post 120.

Figure 18:
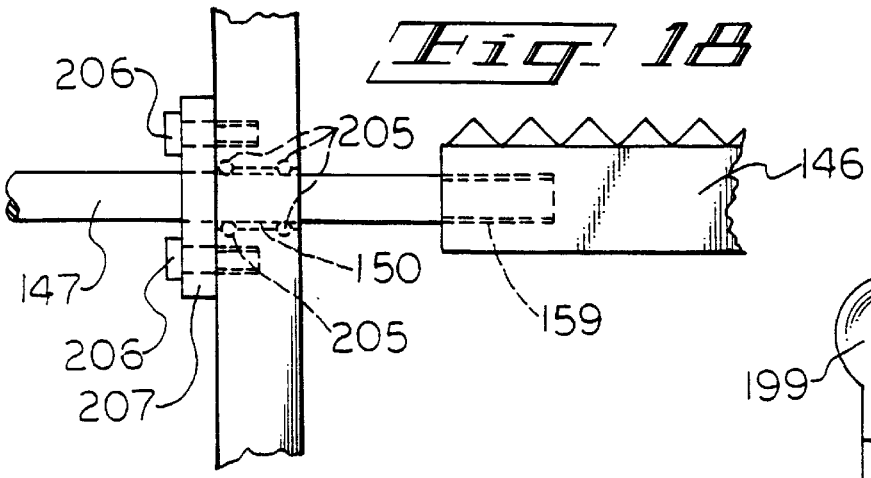
FIG. 18 is an enlarged side view of the piston and rack of FIG. 17.

FIG. 18 shows an enlarged view of the connection of the elongated bar 147 to the piston 149 and the threading of the elongated bar 147 into the rack 146. There is shown the center aperture 150 in the piston, seals 205, bolts 206, and the centering plate 207.

Figure 19:
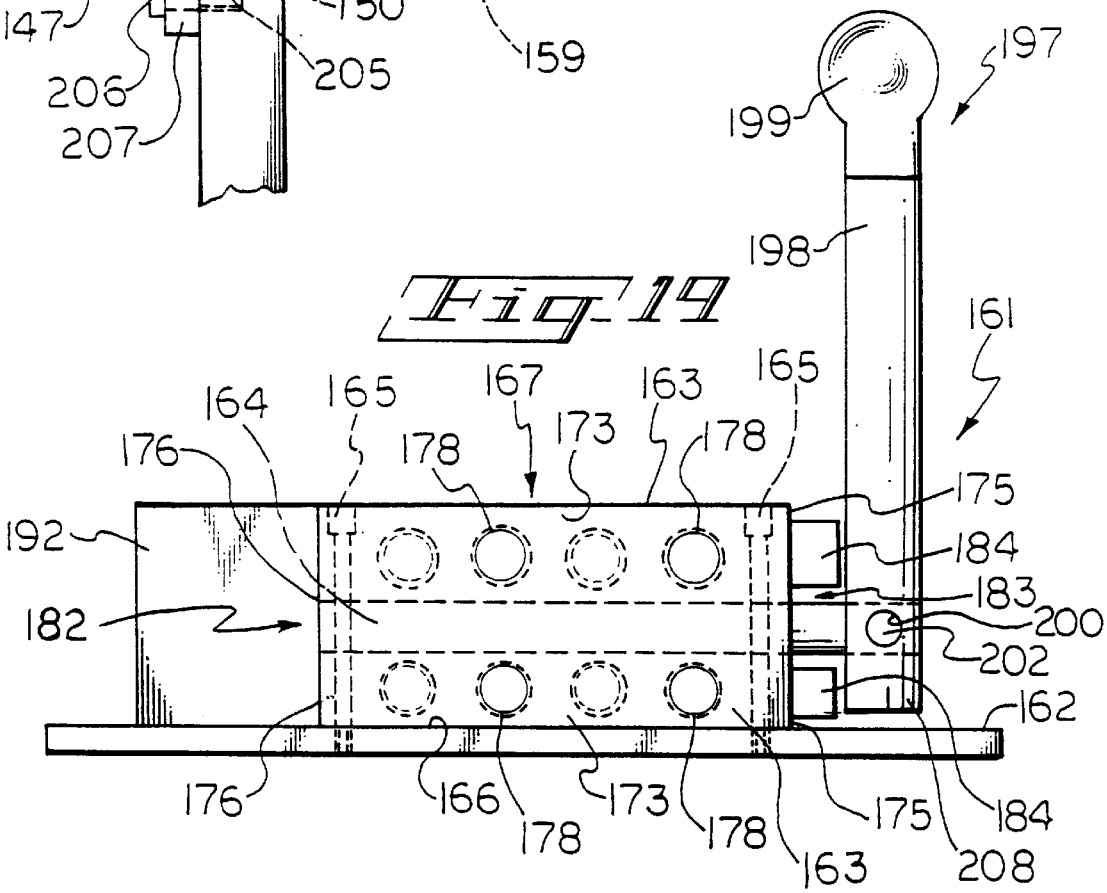
FIG. 19 is a full side view of a novel control valve of this invention.

Turning now to FIG. 19, associated with the devices of this invention is a novel control valve 161 that is used on the lift chairs thereof. The novel control valve 161 comprises a base 162 and surmounted on said base 162, are two independent, essentially identical control blocks 163 and a solid wall block 164, one such control block 163 being surmounted by the wall block 164, the other control block 163 surmounting the wall block 164.

There is a means 165 (shown in phantom in FIG. 19) of locking the blocks 163 and 164 in a rigid configuration.

Figure 20:
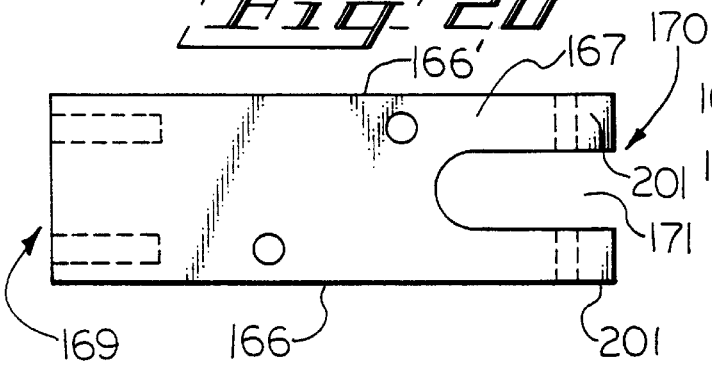
FIG. 20 is a full top view of the wall block of FIG. 19.
Figure 21:
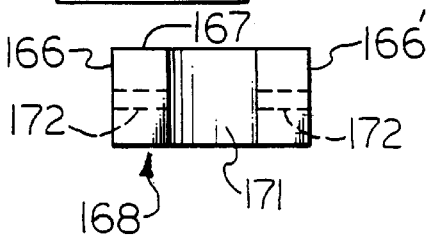
FIG. 21 is a full right end view of the wall block of FIG. 20.

The wall block 164 (FIG. 20) has two side walls, a front side wall 166 and a back side wall 166', a top surface 167, a bottom surface 168 not shown in FIG. 20, a left end 169 and a right end 170. The wall block 164 extends beyond the control blocks 163 on the right end 170, and the wall block 164 has an elongated notch 171 at the right end 170 thereof. As shown in FIG. 21, the notch 171 extends through the wall block 164 from the top surface 167 through the bottom surface 168, said wall block 164 having an aperture 172 through the right end 170 extending from the front side wall 166 through the back side wall 166'.

Figure 23:
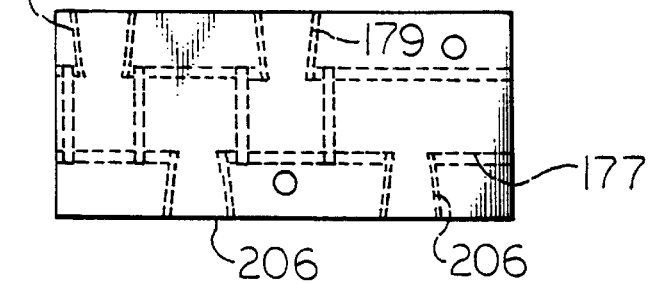
FIG. 23 is a full top view of a control block of FIG. 19 showing the side outlets, seals, and center core in phantom.
Figure 25:
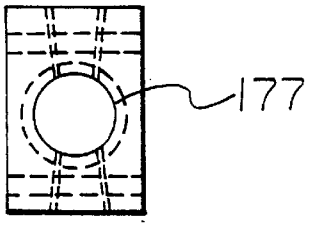
FIG. 25 is a full end view of a control block of this invention from the right side, shown the center core and holes for fastening the block to the wall block in phantom.
Figure 26:
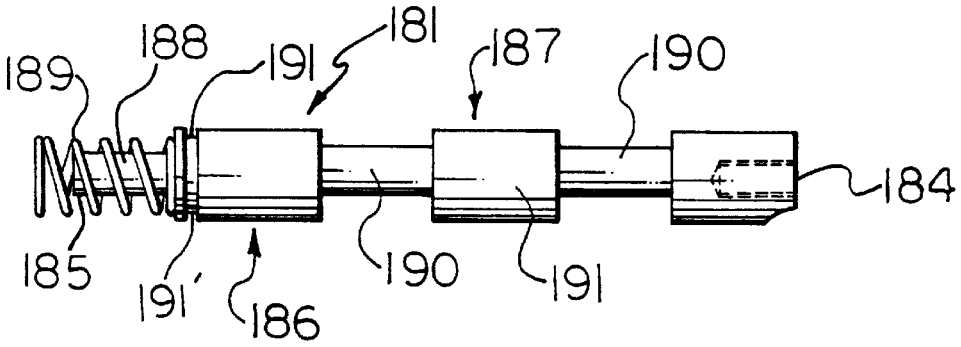
FIG. 26 is a full top view of a valve stem of the control valve of FIG. 19.

As shown in FIG. 19, each control block 163 has a front side wall 173 and a back side wall a right end 175 and a left end 176 and an open center core 177 having an internal surface 178, said open center core 177 running through each said control blocks 163 from the right end 175 to the left end 176. Each of the front side walls 173 has two ports 206 therein extending through to the open center core 177. The ports 206 are spaced apart and located nearer the right end 175 of the front side walls 173 of the control blocks 163. Each of the back side walls have two ports 179 therein extending through to the open center core 177 (FIG. 23), said ports 179 being spaced apart and located nearer the left end 176 of the back side walls of the control block 163. The ports and the center core are intended to openly communicate with each other when the valve stems are activated.

With reference to FIGS. 22 to 25, each said open center core 177 contains four elastomeric seals 180, said seals 180 being circular in configuration and conforming essentially to the diameter of the internal surface 178 of the open center core 177.

Figure 22:
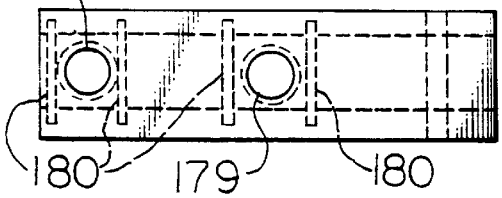
FIG. 22 is a full side view of the back of the control block of FIG. 19 showing the seals and the center core in phantom.
Figure 24:
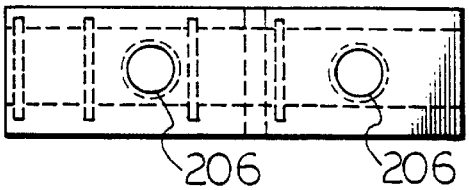
FIG. 24 is a full side view of the front of the control block of FIG. 19 showing the seals and center core in phantom.

As shown in FIG. 22, one each of the seals 180 is positioned such that it is located adjacent a port 179 opening through the back side wall to prevent leakage of air or fluid around the valve stems 181.

There are two identical valve stems 181 in each control valve 161 capable of having an active position and being located respectively in the open center core 177 such that the valve stems 181 extend beyond each of the left ends 182 and right ends 183 of the combination of control blocks 163 and wall block 164.

Each valve stem 181 has a right end 184 and a left end 185, a front side wall 186 and a back side wall 187. Each valve stem 181 has spring supports 188 on the left end 185 thereof, each said spring support 188 having a compressible spring 189 slidably mounted thereon.

Each of the valve stems 181 have two notches or grooves 190 in each of the side walls 186 and 187, extending from the top to the bottom each notch 190 in the front side walls 186 being aligned with a respective port 206 in the front side wall 173 of the control blocks 163 when the valve stem 181 is in an active position and each notch 190 in the back side wall 187 of the valve stem 181 being aligned with a respective port 179 in the back side wall of the control blocks 163 when the valve stem 181 is in an active position.

There is additionally, a means to retain each valve stem 181 in the open center core 177, such as a retainer ring 191.

Figure 27:
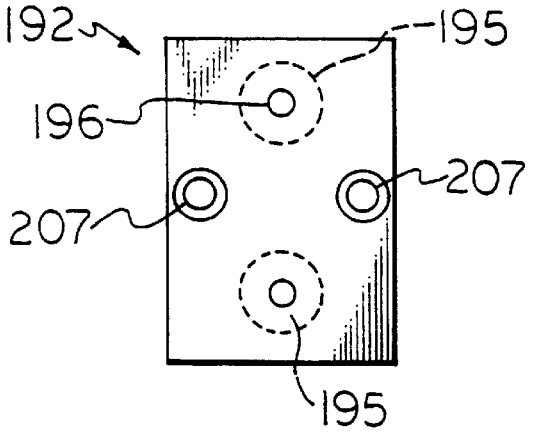
FIG. 27 is a full end view of the stem cover of the control valve of FIG. 19, showing the fastening means and, the indentions and center apertures in phantom.
Figure 28:
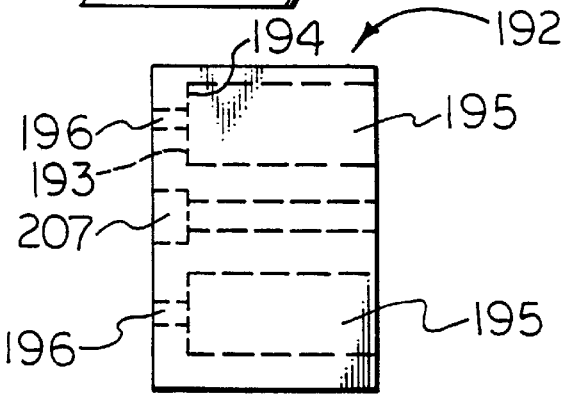
FIG. 28 is a full side view of the stem cover of the control valve of FIG. 19, showing the fastening means, the indentions,m and the center apertures, all in phantom.

At the left end, a valve stem reception cover 192 covers the left end 185 of the valve stem 181 and compressible spring 189, said cover 192 (FIGS. 27 and 28) has a back wall 193 with an internal surface 194 and said cover 192 being detachedly fixed by a fastener 207 to the combination of control blocks 163 and wall block 164.

The internal surface 194 of said back wall 193 has a centered indention 195 therein to accommodate the spring support 188 when a respective valve stem 181 is advanced in the open center core 177, each indention 195 having an aperture 196 centered therein through the back wall 193 thereof to allow for the release of air that is pushed into the indentions 195 when the valve stems 181 advance.

Returning to FIG. 19, the extended right end 184 of each of the valve stems 181 is contacted by a control handle 197, said control handle 197 being comprised of an elongated rod 198 surmounted by a gripping knob 199, said elongated rod 198 having a lower end 208, said lower end 208 having an aperture 200 therethrough, the aperture 200 in said control handle 197 being aligned with the aperture 172 in the side walls 201 of the right end 170 of the wall block 164 and having a pin 202 inserted therethrough to lock the control handle 197 in the wall block 164 such that the lower end 208 of the elongated rod 198 does not rest on the base 162.

The control valve 161 is hooked into a pressurized system through the ports 179 and 206 to provide a power means for operating the control valve 161. With regard to FIG. 19, the control valve 161 is operated by moving the control handle 197 either forward or backward to actuate the valve stems 181. In FIG. 19, if the control handle 197 is pushed forward (towards the control valve 161), the top valve stem 181 is activated and when the control handle 197 is pulled away from the control valve 161, the bottom valve stem 181 is activated. By activation, the inventor herein means that the ports and valve stem are aligned such that two sets on either the upper or lower level of the control valve blocks allow the passage of air or liquid to drive the lift chair of the devices of this invention.

I claim:

1. An independent lift comprising:

two spaced apart, vertical posts, each vertical post having a top end and a bottom end, and a front and a back, each vertical post being capable of being secured by the bottom end to a solid substrate, each said vertical post having a plate rigidly affixed to the bottom end, each said plate having a top surface, each said plate having a connector means detachedly fixed to the top surface;

two independent lifting arms, each said lifting arm having a near end and a distal end, a midpoint, and a back surface, each said lifting arm being attached to a first rotatable shaft at its near end, each said first rotatable shaft having an outer end and an inner end, and being supported on each of the outer and inner ends, by a bearing situated in a first bearing housing said shaft being supported by a respective bearing within each first bearing housing;

each first bearing housing being attached to the top respectively, of each vertical post;

each said first bearing housing having fixedly mounted near each near end, of each first rotatable shaft a non-rotating sprocket and fixed to each distal end, of each first rotatable shaft a middle sprocket, each middle sprocket being rotatable simultaneously with each respective, first rotatable shaft;

each said lifting arm being secured near the distal end to a second bearing housing;

a lifting bar common to both lifting arms being rotatably secured in each of the second bearing housings and being supported by a bearing within the second bearing housing;

said lifting bar extending through the bearing housings to provide a support for upper rotating sprockets rigidly affixed to the lifting bar at the support;

said non-rotating sprockets and said upper rotating sprockets being connected by a non-moving chain;

each said lifting arm having a rigid brace with a near end and a distal end fixedly attached at its near end to the back surface of the lifting arm at or near the midpoint of the lifting arm;

two essentially identical hydraulic assemblies, having a fixed end and a shaft end, said hydraulic assemblies having a housing, a movable piston therein and a piston shaft attached to the piston, each said hydraulic assembly respectively, mounted on the top surface of the bottom plate by the connector means, each piston shaft pivotally attached to the distal end of the rigid brace on each of the respective lifting arms;

the lifting bar having a lifting chair rigidly attached to it by chair support shafts; said chair being provided with a control for the control of the pistons in the hydraulic assemblies;

each said vertical post having a lower bearing housing fixedly attached near the bottom end of the vertical post and containing therein a bearing;

said independent lift having a lower rotating bar common to the vertical posts, said lower rotating bar extending from one vertical post to the other vertical post and through the lower bearing housings and being supported by the bearings located therein;

a set of lower sprockets being detachedly fixed to each end of the lower rotating bar and capable of being rotated simultaneously with the rotation of the lower rotating bar;

each respective lower sprocket being connected to a respective middle sprocket by a movable chain;

said independent lift being adapted to a means to power the piston in each piston assembly;

one of the vertical posts having attached on its back, a manifold to accommodate the power means.

* * * * *